US006405536B1

(12) United States Patent
Ho et al.

(10) Patent No.: US 6,405,536 B1
(45) Date of Patent: Jun. 18, 2002

(54) GAS TURBINE COMBUSTOR BURNING LBTU FUEL GAS

(76) Inventors: Wu-Chi Ho; Ling-Chia Weng; Henry Jan, all of Building 52, 195-12 Sec. 4, Chung-Hsing Road, Chutung Hsinchu (TW), 310

( * ) Notice: Subject to any disclaimer, the term of this patent is extended or adjusted under 35 U.S.C. 154(b) by 0 days.

(21) Appl. No.: 09/535,726

(22) Filed: Mar. 27, 2000

(51) Int. Cl.[7] ..... F02C 3/22
(52) U.S. Cl. ..... 60/742; 60/748; 60/760
(58) Field of Search ..... 60/740, 742, 748, 60/752, 760, 39.23, 39.463

(56) References Cited

U.S. PATENT DOCUMENTS 2,638,745 A * 5/1953 Nathan ..... 60/748
3,078,672 A * 2/1963 Meurer ..... 60/748
3,608,309 A * 9/1971 Hill et al. ..... 60/748
3,630,024 A * 12/1971 Hopkins ..... 60/748
5,337,961 A * 8/1994 Brambani et al. ..... 60/742
5,381,652 A * 1/1995 Mezzedimi et al. ..... 60/748
5,394,688 A * 3/1995 Amos ..... 60/748

* cited by examiner

*Primary Examiner*—Michael Koczo
(74) *Attorney, Agent, or Firm*—Raymond Y. Chan; David and Raymond Patent Group

(57) ABSTRACT

A gas turbine combustor burning LBTU fuel gas serves to be applied to the combustion system of a small turbogenerator. The combustion system is composed of a combustor outer case, a combustor liner, a combustor transition section, a radial swirler with adjustable blades and fuel supply passages. The small turbogenerator (10 KW) with the redesigned combustion system is integrated by a LBTU gas generator. A recirculation bubble with proper size and strength is aerodynamically formed by the interaction among the swirling air jet, inclined fuel jet and the primary jets. Since an adjustable swirler is installed, the swirl number of the swirling air jet can be modified to meet the requirements of combustion load sharing and burning different LBTU fuel gases. To eliminate the possible hot spots and thus reduce the pattern factor value, two rows of cooling jet holes are arranged in the rear section of the combustor.

16 Claims, 4 Drawing Sheets

GAS TURBINE COMBUSTOR BURNING LBTU FUEL GAS

BACKGROUND OF THE INVENTION

1. Field of the Invention

The present invention relates to a gas turbine combustor burning LBTU (low BTU) fuel gases, and especially to a can combustor employed in a small turbogenerator (10 KW), which is integrated by LBTU gas generator. A very strong recirculation zone is generated in the primary zone of the combustor to increase the flame-stabilization capability.

2. Description of the Prior Art

In the recent years, the use of LBTU fuel gas, obtained from biomass, process byproduct, coal, and industrial waste, in gas turbine for electricity generation is of special interest due to the considerations of energy saving and environmental protection. From the economical viewpoint, the above system may be commercialized in the power output range of above few MWs because of high initial capital investment. In addition, an abundant supply and easy access of the raw material for generating LBTU gas is essential for the power plant operation. However, the present invention is focused on the small turbogenerator applications since the generation amount of LBTU gas is small in some places.

One major challenge to overcome in making the very small turbogenerator using LBTU fuel possible is designing a gas turbine combustion system that will burn LBtu gas properly and completely. Most large industrial gas turbines have large combustion chambers to support the complete combustion need of LBTU gas once the fuel delivery and injection system has been modified. As designing the gas turbine combustor burning the LBTU gas under a stringent size constraint, several performance characteristics are emphasized in the present invention. One of the most concerned characteristics is the flame stabilization capability of the combustor.

SUMMARY OF THE INVENTION

The primary object of the present invention is to provide a gas turbine combustor burning LBTU fuel gas with high combustion efficiency and stability.

Another object of the present invention is to provide a combustion system matching with a 10 KW turbogenerator originally fueled by diesel fuel. A fuel inlet is designed for supplying the high BTU gas in order to increase of the flamability range and facilitate the engine starting.

A further object of the present invention is to provide a gas turbine combustor which is used the LBTU gas jet to enhance the fuel/air mixing and to facilitate the flame stabilization.

A still object of the present invention is to provide a gas turbine combustor having the advantage of waste processing and environmental protection.

The gas turbine combustor with the aforesaid advantages includes: a combustor outer case having a barrel with a reduced end portion and being enclosed at the outer periphery of the combustor liner, the annular between the outer case cartridge and liner serving as a path for being entered by the reverse flow of a compressed air;

a combustor liner, the front section, middle section and rear section thereof being installed with a row of primary holes, a row of dilution holes, a first row of cooling holes, and a second row of cooling holes; one and portion of the inner liner being installed with a conical of liner for being combined with the base of a radial swirler;

a adjustable swirler formed by a radial swirler base and a swirler angle controller, wherein the radial swirler base serves to seal the distal portion of the combustor and has a hollow structure, after the hollow portion is assembled to the gas inlet, a slit is formed; the swirler is radially installed with guide plates and sealing plates; the swirler angle controller is formed by a pinion and an annular angle controller the inner periphery of which is installed with a linkage for driving the radial swirler in order to adjust the orientation of the blades of the annular angle controller;

a fuel gas nozzle connected to the swirler base by a flange, an inlet for fuel gas with high heating value is installed at the center, an annular flow path for inputting LBTU gas is installed at gas inlet joint, the outlet of the flow path has an inclined design for forming with an inclined fuel gas injection.

After compressed air flows into combustor, it will further flow to the channel through the annular between the outer case and the liner, therefore, the air will first enter into the dilution region and intermediate region and then arrive at the primary region and the frontal section. Thus, the combustor of the present invention is a reverse flow type combustor. After air enters into the front section, it will be further guided by a radial swirler vanes and then generating a strong swirling jet into the combustion chamber. The recirculation zone due to the vortex breakdown of the swirling jet is then formed. To preserve the recirculation zone and enhance the mixing between the fuel and combustion air, the gas inlet for LBTU gas is designed to be inclined. The primary jets emerging from a proper axial position will close the recirculation zone and supply the fresh air for the combustion need of the fuel gas in the primary zone. Consequently, a stable flame stabilization mechanism can be generated under the interaction among the swirling air jet, inclined fuel jet and the primary jets. The dilution jets can mix with high temperature combustion gas from the primary zone and then reduce the combustion gas temperature to a certain level which is acceptable by the turbine section. The main purpose of the intermediate region is to provide a combustion room for complete combustion of the fuel gas. Air streams from the first and second rows of the cooling holes serves to eliminate the hot spots near the outer combustion liner and thus reduce the outlet pattern factors.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
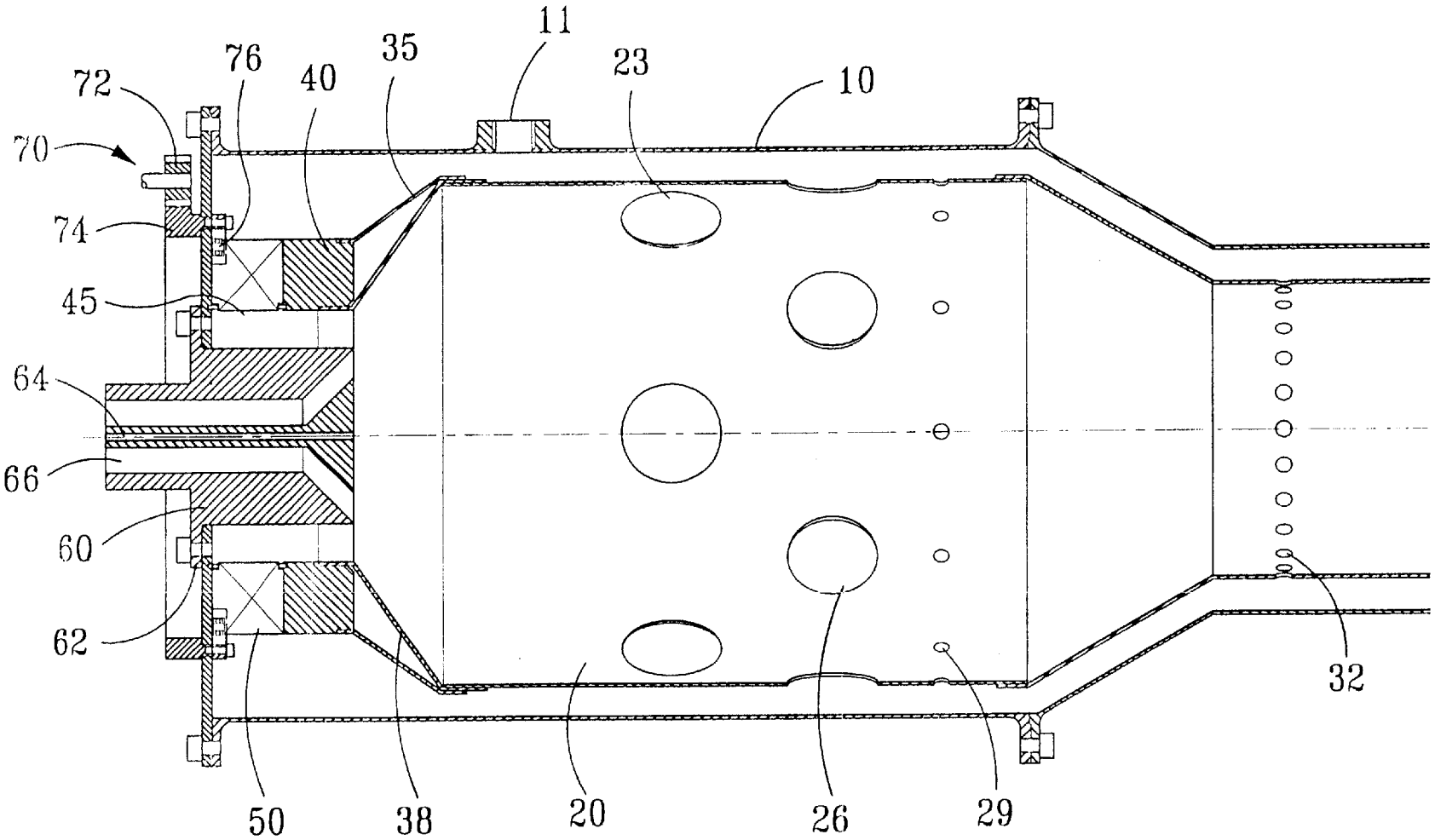
FIG. 1 is a plane schematic view showing the gas turbine combustor burning LBTU fuel gas.
Figure 2:
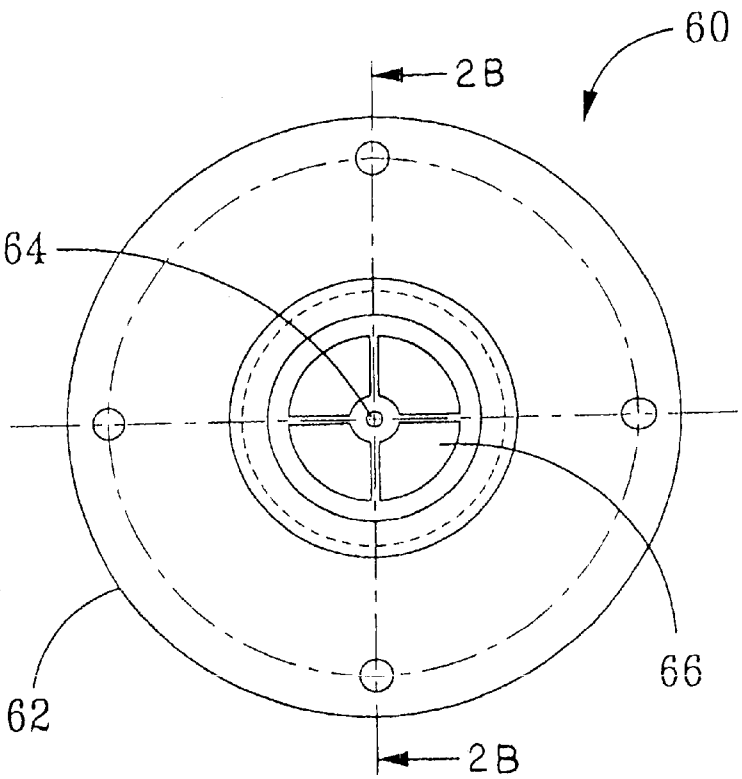
FIGS. 2A and 2B are a schematic view and a sectional view respectively, showing the annular inlet for LBTU fuel gas and a round passage for fuel gas of high heating value.
Figure 2:
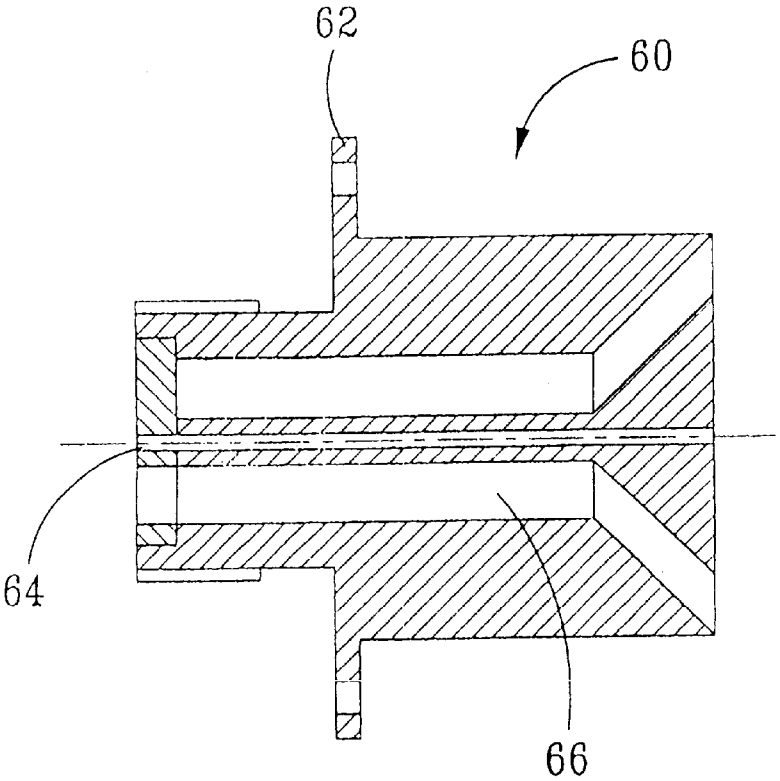
Figure 3:
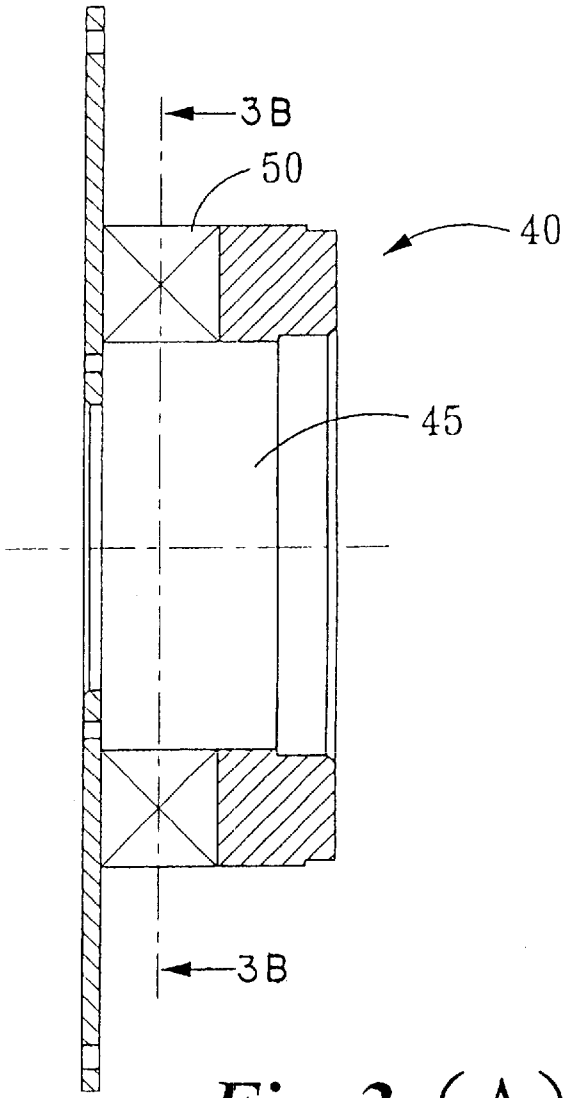
FIGS. 3A and 3B are a partially sectional view and a scematic view respectively, showing the base of the radial swirler of the gas turbine combustor using LBTU fuel gas.
Figure 3:
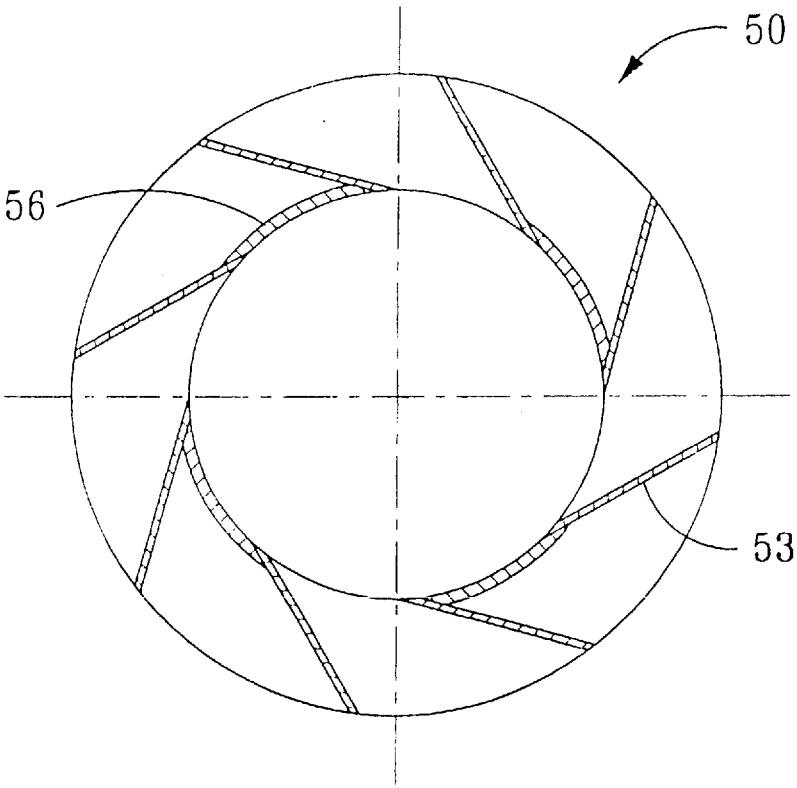
Figure 4:
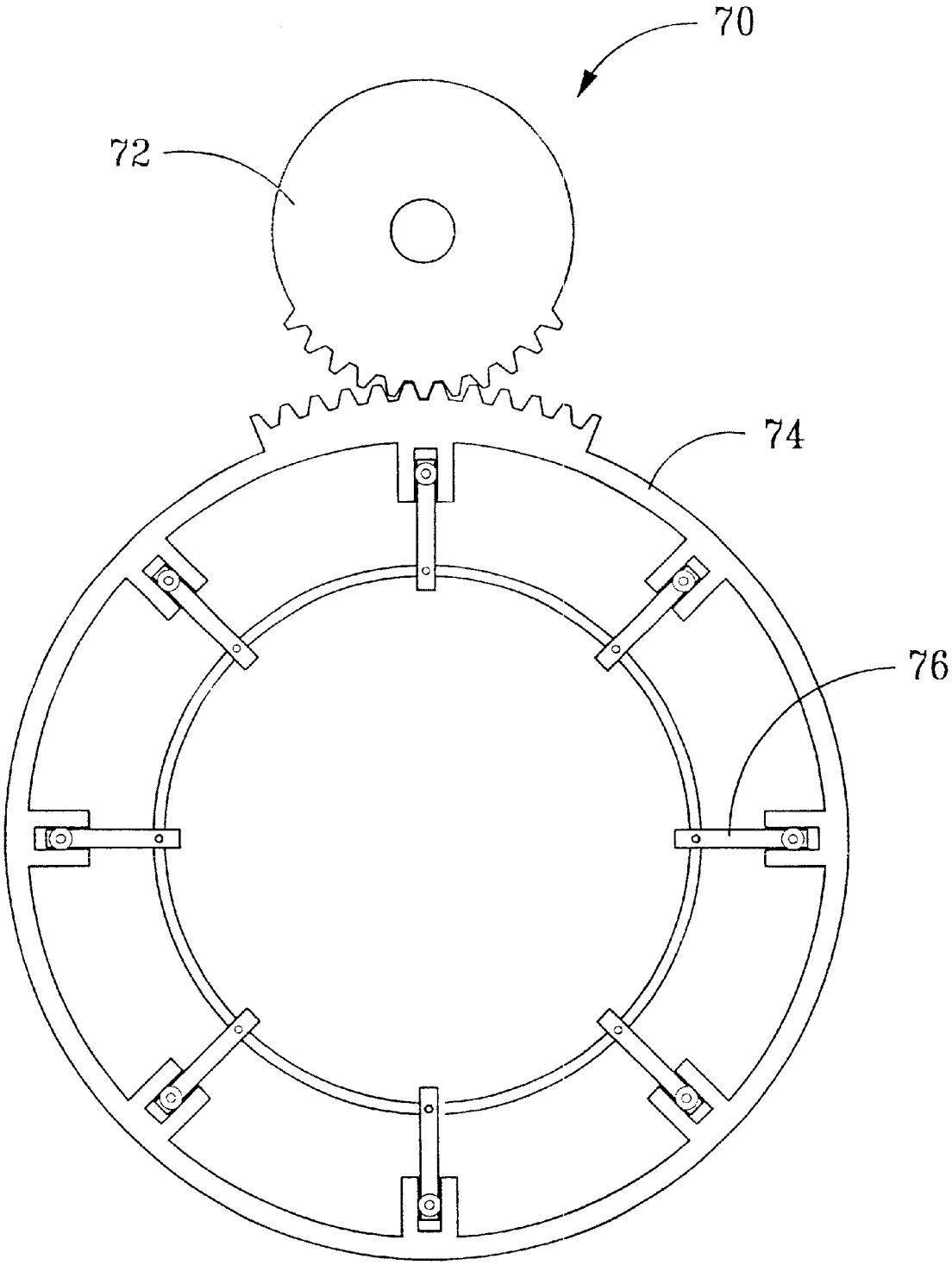
FIG. 4 is a schematic view showing the angle control device of the swirler vanes in the LBTU combustor system.

With reference to FIG. 1, the gas turbine combustor burning LBTU fuel gas of the present invention is illustrated. This gas turbine combustor is composed of a combustor outer casing 10, a combustor liner 20, an adjustable radial swirler 40, a fuel nozzle 60, and a swirler angle control set 70.

The combustor outer casing 10 is a cylindrical barrel with a reduced neck portion to meet the interface requirement of the 10 KW turbo-generator. Compressed air from the compressor will flow through the annular passage between the outer casing 10 and the combustor liner 20 to provide the combustion need of the LBTU gas. In addition, a spark plug is installed through a round hole 11 for ignition.

Basically, the combustor liner 20 is divided into a primary zone, an intermediate zone, and a dilution zone. The objectives of the primary jets, which are generated by the airflow through a row of primary holes 23, are to provide the combustion air to the primary zone and to close a recirculation bubble due to a vortex breakdown of a swirling air jet. The main purpose of a row of dilution holes 26 is to create a plurality of dilution jets. A plurality of wall jets emerging from a first row of cooling holes 29 and a second row of cooling holes 32 are installed to eliminate the hot spots near the liner wall so that the acceptable pattern factor on the exit plane of the combustor liner 20 can be obtained.

The radial swirler 40 is installed in a front end of the combustor liner 40 to guide the compressed air flowing into the swirl chamber 45. The vortex breakdown of the swirling air jet emerging from the swirl chamber 45 results in a recirculation bubble for the need of the flame-holding purpose. The swirling strength of the swirling air jet can be adjusted by the angle of a plurality of vanes 53 mounted on the radial swirler 40.

The swirler angle control set 70 comprises a pinion 72 and a vane angle controller 74 driven by the pinion 72. Linkages 76 are installed in an inner rim of the vane angle controller 74 for driving the radial swirler 45 for adjusting the orientation of the vanes 53.

The fuel nozzle 60 is combined with the radial swirler 40 by a flange 62. A round passage 64 for fuel gas of high heating value is designed to facilitate the engine starting and to increase the heating value of fuel as the heating value of the main fuel gas is too low. The annular channel 66 for the LBTU fuel gas is designed to generate the inclined annular fuel jet and to facilitate the formation of the recirculation zone.

The present combustor is categorized in the reverse type because compressed air enters the present combustion system from the annular passage in the side of the combustor exit. As a result, the combustion air will be preheated before it enters into the combustion region. Since a large amount of the LBTU fuel gas is required to meet the requirement of the heat output in the present power generation system, a strong flame-holding mechanism is required. A stable recirculation zone is established in the primary zone of the combustor for the flame-holding purpose. This circulation bubble plays an important role in flame stabilization by providing a hot flow of recirculated combustion products and a reduced velocity region where flame speed and flow speed can be matched. Mainly, the recirculation zone is generated by the vortex breakdown of the swirling jet from the swirl chamber 45. The primary jets form holes 23 to not only provide fresh air to the primary zone but also close the recirculation zone. In addition, the sudden-expansion effect of lee side of the fuel nozzle 60 is able to facilitate the recirculation zone generation and thus to enhance the flame-holding capability.

The inclined liner wall 38 is designed in the dome region so as to avoid the creation of a comer separation bubble. The fuel gas is injected from an annular passage 66 which is radially inclined. The purpose of this fuel gas nozzle is two-fold. The first purpose is that the recirculation bubble due to the vortex breakdown will not be destroyed by the high-speed gas flow. Another purpose is to create a strong shear flow between the fuel gas flow and the swirling air jet so that the mixing in the primary zone can be enhanced.

The axial location and penetration depth of the primary jets plays a crucial role to the recirculation bubble in the primary zone. Through the parametric study of three-dimensional combusting flow analysis, it is found that the most suitable location of the primary jet hole is 1.3 R (combustor radius) from the outlet of the fuel gas nozzle. To truly close the circulation bubble, the penetration depth of the primary jet should be deep enough. Therefore, the momentum ratio of the primary jet has to be greater than a certain value. The axial distance between the primary jet hole 23 and the dilution jet hole 26 is designed to 0.62 R. The intermediate region is then resulted for sharing the combustion load of the primary region. Since the high temperature combustion stream may pass through the dilution jets into the dilution zone, the wall jets from a row of holes 29 can eliminate the possible hot spots and protect the combustor liner wall of the dilution region. The wall jets from a row of holes 32 can further tune the temperature distribution to reduce the pattern factor on the outlet plane of the combustor.

Another, by using the swirler vane angle controller 70 the tangential velocity component of the air flow into the swirl chamber will be changed so that the swirl number of the swirling air jet will be changed accordingly. This provides an aerodynamically control method to adjust the size and strength of the recirculation bubble in the primary zone. The first function of the adjustable swirler is to tune the combustion loading of the primary region. Therefore, the maximum combustion temperature can be controlled. The second function is to enhance the handling capability for fueling different LBTU fuel gases into the small turbogenerator. When the fuel gas composition is changed, the combustion characteristics will be changed accordingly. The adjustable swirler can provide a control method to meet the combustion requirement of the LBTU gas.

The gas turbine combustor burning LBTU fuel gas has the following advantages than the prior art:

1. The swirling strength of the air flow through the swirl chamber can be adjustable using the radial swirler controller. The recirculation zone may be formed if the swirl number of the swirling jet is greater than a certain critical value. The recirculation bubble can be further stabilized by the primary jet and the inclined fuel jet. The sudden-expansion effect of lee side of the fuel nozzle 60 is able to facilitate the recirculation zone generation and thus to enhance the flame-holding capability.
2. An inlet for fuel gas with high heating value is installed for the engine starting purpose. In addition, it also serves to enhance the flamability of the LBTU fuel gas as the heating value of the LBTU gas is too low.
3. To enhance the handling capability of different LBTU gases, an adjustable swirler is installed to modify the size and strength of the recirculation bubble formed in the primary region.
4. Two rows of wall jets are employed to eliminate the possible hot spots and minimize the temperature pattern factor on the outlet plane of the combustor.
5. The present invention helps to reduce the waste problem and saves the finite fossil fuel reserves.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A gas turbine combustor for burning a LBTU fuel gas, comprising:

a combustor liner, which is divided into a front primary zone, an intermediate zone and a rear dilution zone, having a row of primary holes radially distributed thereon, a row of dilution holes radially distributed thereon, a first row of cooling holes radially distributed thereon, and a second row of cooling holes radially distributed thereon, wherein primary jets are generated by a first airflow through said row of primary holes so as to provide a combustion air to said primary zone and to close a recirculation bubble in said primary zone due to a vortex breakdown of a swirling air jet, wherein said intermediate zone is resulted for sharing a combustion load of said primary zone and dilution jets are generated by a second airflow through said row of dilution holes that a high temperature combustion stream passes through said dilution jets into said dilution zone, wherein wall jets are emerged from said first and second rows of cooling holes for eliminating hot spots formed near an inclined liner wall at said dilution zone of said combustor liner and tuning a temperature distribution to reduce a pattern factor on an outlet plane of said combustor liner respectively;

a combustor outer casing, which is a cylindrical barrel having a reduced diameter end portion, enclosing said combustor liner therein to define an annular passage between said combustor liner and said combustor outer casing for a compressed air flowing through;

a radial swirler which has a swirl chamber axially defined therein and is installed in a front end of said combustor liner so as to guide said compressed air to flow into said combustor liner through said swirl chamber, wherein said vortex breakdown of said swirling air jet emerging from said swirl chamber results in said recirculation bubble so as to establish a recirculation zone in said primary zone of said combustor liner;

a plurality of vanes mounted on said radial swirler;

a fuel nozzle, connected to said radial swirler, having a round passage which is an inlet for fuel gas with high heating value and an annular channel which is disposed surrounding said round passage for inputting said LBTU fuel gas and forming an inclined annular fuel jet to facilitate a formation of a recirculation zone; and a swirler angle control set comprising a pinion, a vane angle controller driven by said pinion to move, and a plurality of linkages spacedly installed in an inner rim of said vane angle controller for driving said radial swirler for adjusting an angle of said vanes so as to adjust a swirling strength of said swirling air jet.

2. The gas turbine combustor, as recited in claim 1, wherein said annular passage of said fuel nozzle is radially inclined for facilitating said formation of said recirculation zone so as to enhance a flame-holding capability.

3. The gas turbine combustor, as recited in claim 1, wherein said inclined liner wall is formed in a dome region so as to avoid a creation of a corner separation bubble.

4. The gas turbine combustor, as recited in claim 2, wherein said inclined liner wall is formed in a dome region so as to avoid a creation of a corner separation bubble.

5. The gas turbine combustor, as recited in claim 1, wherein a ratio of a distance between said primary holes and a rear end of said round passage of said fuel gas nozzle and a radius of said combustor liner is 1.3 R.

6. The gas turbine combustor, as recited in claim 2, wherein a ratio of a distance between said primary holes and a rear end of said round passage of said fuel gas nozzle and a radius of said combustor liner is 1.3 R.

7. The gas turbine combustor, as recited in claim 3, wherein a ratio of a distance between said primary holes and a rear end of said round passage of said fuel gas nozzle and a radius of said combustor liner is 1.3 R.

8. The gas turbine combustor, as recited in claim 4, wherein a ratio of a distance between said primary holes and a rear end of said round passage of said fuel gas nozzle and a radius of said combustor liner is 1.3 R.

9. The gas turbine combustor, as recited in claim 1, wherein a ratio of an axial distance between said primary holes and said dilution holes and a radius of said combustor liner is 0.62.

10. The gas turbine combustor, as recited in claim 2, wherein a ratio of an axial distance between said primary holes and said dilution holes and a radius of said combustor liner is 0.62.

11. The gas turbine combustor, as recited in claim 3, wherein a ratio of an axial distance between said primary holes and said dilution holes and a radius of said combustor liner is 0.62.

12. The gas turbine combustor, as recited in claim 4, wherein a ratio of an axial distance between said primary holes and said dilution holes and a radius of said combustor liner is 0.62.

13. The gas turbine combustor, as recited in claim 5, wherein a ratio of an axial distance between said primary holes and said dilution holes and said radius of said combustor liner is 0.62.

14. The gas turbine combustor, as recited in claim 6, wherein a ratio of an axial distance between said primary holes and said dilution holes and said radius of said combustor liner is 0.62.

15. The gas turbine combustor, as recited in claim 7, wherein a ratio of an axial distance between said primary holes and said dilution holes and said radius of said combustor liner is 0.62.

16. The gas turbine combustor, as recited in claim 8, wherein a ratio of an axial distance between said primary holes and said dilution holes and said radius of said combustor liner is 0.62.

* * * * *